US007501921B2

(12) United States Patent
Richards et al.

(10) Patent No.: US 7,501,921 B2
(45) Date of Patent: Mar. 10, 2009

(54) TEMPERATURE CONTROLLED MAGNETIC ROLLER

(75) Inventors: Raymond S. Richards, Toledo, OH (US); Randall Boudouris, Sylvania, OH (US)

(73) Assignee: MagnetNotes, Ltd., Toledo, OH (US)

( * ) Notice: Subject to any disclaimer, the term of this patent is extended or adjusted under 35 U.S.C. 154(b) by 350 days.

(21) Appl. No.: 11/129,213

(22) Filed: May 13, 2005

(65) Prior Publication Data

US 2006/0255895 A1 Nov. 16, 2006

(51) Int. Cl.
*H01F 1/08* (2006.01)
*H01F 13/00* (2006.01)

(52) U.S. Cl. ..... 335/284; 335/302; 335/306; 148/103; 148/108

(58) Field of Classification Search ..... 335/284–288, 335/302, 306; 148/103, 108
See application file for complete search history.

(56) References Cited

U.S. PATENT DOCUMENTS

| | | | | |
|---|---|---|---|---|
| 3,127,544 | A | 3/1964 | Blume, Jr. | 317/203 |
| 3,206,655 | A | 9/1965 | Reijnst | 317/159 |
| 3,810,055 | A * | 5/1974 | Wright | 335/285 |
| 4,022,701 | A | 5/1977 | Sawa et al. | 252/62.54 |
| 4,292,261 | A | 9/1981 | Kotani et al. | 264/24 |
| 4,379,276 | A | 4/1983 | Bouchara et al. | 335/284 |
| 4,728,419 | A * | 3/1988 | Grun | 209/219 |
| 5,107,238 | A | 4/1992 | Leupold | 335/306 |
| 5,424,703 | A | 6/1995 | Blume, Jr. | 335/284 |
| 6,190,573 | B1 | 2/2001 | Ito | 252/62.55 |
| 6,304,162 | B1 | 10/2001 | Nakatsuka et al. | 335/302 |
| 6,312,795 | B1 | 11/2001 | Yamamoto | 428/323 |
| 6,464,894 | B1 | 10/2002 | Antochin et al. | 252/42.54 |
| 6,596,096 | B2 | 7/2003 | Carl et al. | 148/101 |
| 6,693,506 | B2 | 2/2004 | Matsumura et al. | 336/200 |
| 6,702,845 | B1 | 3/2004 | Cully et al. | 623/1.15 |
| 6,784,255 | B1 | 8/2004 | Nakahama et al. | 525/331.9 |
| 2002/0081446 | A1 | 6/2002 | Boudouris et al. | 428/469 |
| 2003/0077465 | A1 | 4/2003 | Boudouris et al. | |
| 2004/0238072 | A1 * | 12/2004 | Polak et al. | 148/105 |

FOREIGN PATENT DOCUMENTS

| | | | |
|---|---|---|---|
| JP | 61099634 A | * | 5/1986 |
| WO | WO99/28048 | | 6/1999 |
| WO | WO02/42074 A1 | | 5/2002 |

* cited by examiner

*Primary Examiner*—Ramon M Barrera
(74) *Attorney, Agent, or Firm*—Vidas, Arrett & Steinkraus, PA

(57) ABSTRACT

A magnetic roller may comprise a magnetized outer surface and an internal chamber. A temperature control system may be in communication with the internal chamber, and a fluid capable of heat transfer may circulate within the internal chamber and the temperature control system. The magnetic roller may be used to produce magnetic sheets having magnetizable particles that are aligned according the a magnetic field generated by the magnetic roller. The magnetic sheet may be provided in a pliable form wherein magnetizable particles may shift orientation when exposed to the magnetic field. Heat may be transferred between the sheet and the magnetic roller to cause solidification of the magnetic material and prevent dealignment of the magnetic particles.

29 Claims, 8 Drawing Sheets

TEMPERATURE CONTROLLED MAGNETIC ROLLER

BACKGROUND OF THE INVENTION

This invention relates generally to a device for manufacturing flexible magnetic sheets and/or films and to methods of making flexible magnetic sheets and/or films.

The magnetization of materials and production of magnets by applying a magnetizing field to a magnetizable composition is well known. For example, U.S. Pat. No. 4,379,276 to Bouchara, and U.S. Pat. Nos. 3,127,544 and 5,424,703 to Blume, Jr., the disclosures of which are incorporated herein by reference in their entireties, all disclose various devices and processes for the magnetization of materials.

It is further well known that applying a magnetizing field to a magnetizable composition while the composition is in a fluid condition that allows particulate movement will result in alignment of the magnetic particles according to the applied magnetic field, and may substantially increase the strength of the resulting magnet. U.S. Pat. No. 4,022,701 to Sawa et al., incorporated herein by reference in its entirety, discloses such a process. However, the alignment of the magnetic particles, and the resulting magnetic strength, will only be maintained if the aligned condition induced by the magnetizing field can be maintained until the fluid composition sufficiently solidifies to the extent that further movement of the particles is prevented, thereby fixing the orientation of the magnetic particles according to the magnetizing field. Therefore, prior art methods of producing magnets having magnetic particles aligned according to a magnetic field have generally not included production of sheet magnets using traditional high speed roller devices.

There remains a need for an apparatus and method for making magnets in sheet form at high speeds in which the orientation of the magnetic particles are aligned according to an applied magnetic field.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

SUMMARY OF THE INVENTION

In one embodiment, the invention comprises a magnetizing roller having a magnetized outer surface and an internal chamber. A fluid is desirably arranged to circulate throughout said internal chamber to maintain the temperature of the roller within a predetermined range. The fluid may flow throughout a temperature control system.

In some embodiments, the magnetizing roller may comprise a cylindrical body portion and a plurality of magnetic rings disposed about the cylindrical body portion. The roller may further comprise a plurality of ring shaped pole pieces disposed about the cylindrical body portion, and the ring shaped pole pieces may alternate with the magnetic rings along the length of said roller.

In some embodiments, the invention comprises a coating machine having an extruder arranged to provide a continuous sheet of magnetizable material, a magnetizing roller having a magnetized outer surface and an internal chamber and a temperature control system in communication with the internal chamber. A heat transfer fluid may circulate throughout the internal chamber and the temperature control system and maintain the magnetizing roller at a predetermined temperature.

The invention is also directed to a method of making a magnetic sheet comprising: providing a sheet of a magnetizable composition comprising magnetizable particles and a binder, wherein the binder is in a pliable state; providing a magnetic roller having a temperature control system, the magnetic roller having a magnetizing field; running the sheet of magnetizable composition adjacent to the roller such that the magnetizable particles align with the magnetizing field and heat is transferred between the sheet and the roller; and maintaining the sheet adjacent to the roller for a period of time sufficient for the binder to sufficiently solidify such that the magnetizable particles are unable to shift orientation.

In some embodiments, the binder may comprise a thermoplastic material. The roller may be arranged to absorb heat from the magnetic sheet.

In some embodiments, the binder may comprise a thermosetting material. The roller may be arranged to impart heat to the magnetic sheet.

The invention may be used to create magnets with a higher magnetic flux density due to permanently magnetized and aligned magnetic particles. Thus, the invention allows for a very thin layer of magnetic material to be employed.

The present invention allows for the alignment of magnetic particles to be accomplished in a continuous manner.

In some embodiments, additional heat may be removed from or imparted to the magnetic material by an additional device, such as a belt, which may contact a second side of the sheet of magnetic material. A belt may be heated or cooled prior to contacting the magnetic material. In addition, the use of a ferritic belt further enhances the alignment effect.

In some embodiments, additional heat may be removed from or imparted to the magnetic material by an additional device, such as an air handling unit, which may be arranged to direct gases at a predetermined temperature across the magnetic material.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION

Figure 1:
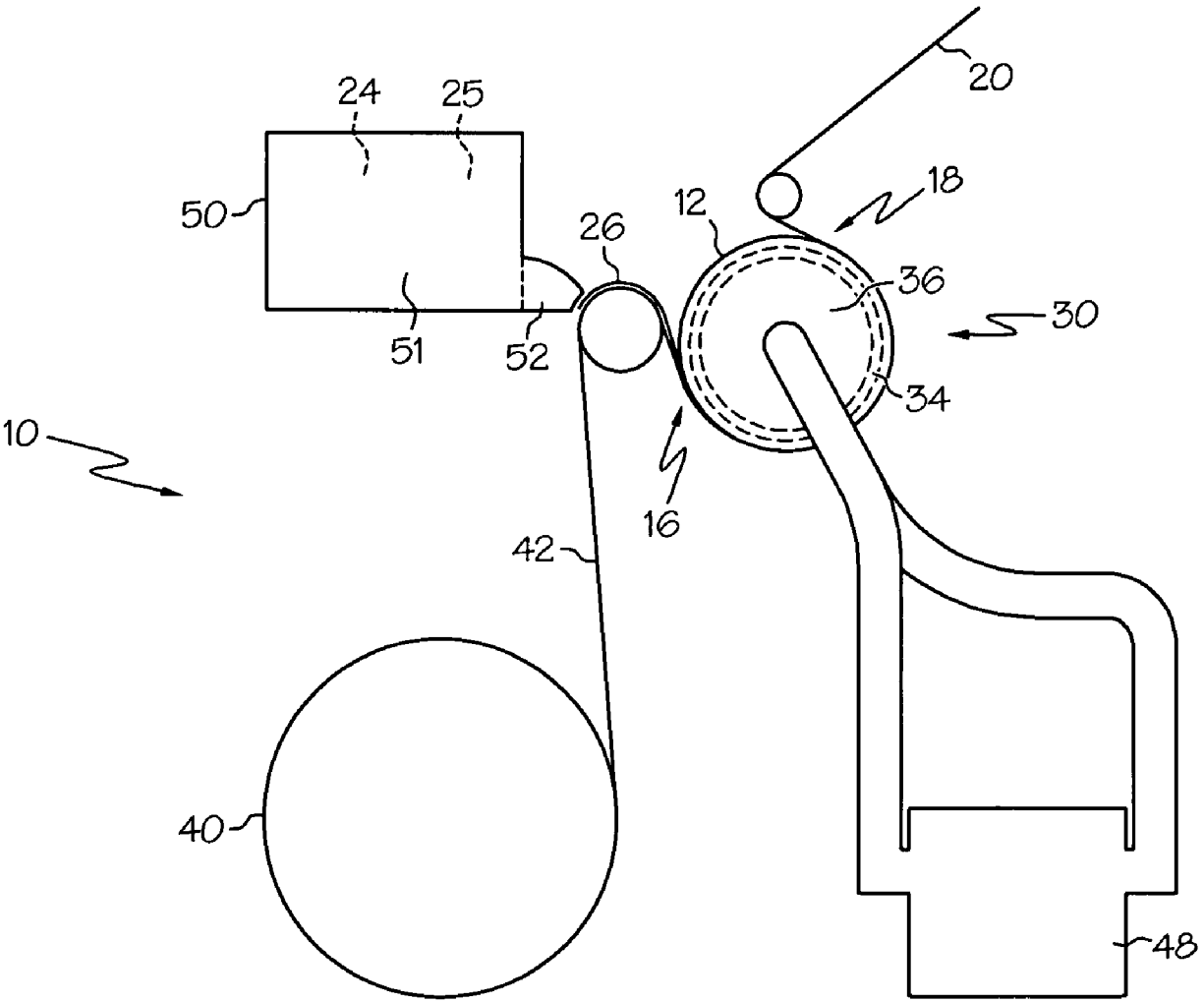
FIG. 1 depicts an embodiment of a coating machine having a temperature controlled magnetic roller.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows a magnetic coating machine 10 having a temperature controlled magnetic roller 12 which is capable of producing finished flexible magnetic films or sheets 20.

The coating machine 10 may include a substrate unwinding station 40 which may provide a continuous sheet of substrate 42 material. In some embodiments, the substrate 42 may comprise polyester, mylar or a printable substrate such as paper, photo paper or transparent films which may be run through a printing press. In some embodiments, the substrate 42 may comprise a release paper and may include an adhesive backing. The substrate 42 may comprise any suitable substance in sheet form that will not melt when exposed to high temperature magnetic material or a high temperature roller. For example, a substrate 42 may comprise cloth, wallpaper, insulation, sound deadening materials, metal foils, etc. In some embodiments, a substrate may be cooled, or may be delivered at a predetermined temperature which may be higher or lower than the temperature of a magnetic material used to form the magnetic sheet 20.

A reservoir 50 may contain a magnetic material or composition 24. In some embodiments a reservoir 50 may comprise a mixer 51 which may mix individual components to form the magnetic composition 24, or a hopper which may receive magnetic composition 24 in pellet form to be melted. In some embodiments a reservoir 50 may include an extruder 52, such as a slot die extruder, which may form the magnetic composition 24 into a sheet 26 and apply the sheet 26 to the substrate 42.

Magnetic composition 24 may comprise a mixture of magnetizable particles 25, such as ferrite oxide particles and/or other soft ferrites, and in some embodiments, hard ferrites. In some embodiments, the magnetic composition 24 may include binders such as thermoplastic binders, thermosetting binders and/or self-setting binders. In some embodiments, the magnetic composition 24 may further include one or more processing aids such as slip additives, antioxidants, coupling agents and the like. For example, processing aids may comprise higher fatty acid esters and amides such as linoleic acid, ricinolic acid, stearic acid, palmitic acid, laulic acid and Kemamide® fatty amides; salts of higher fatty acids such as barium stearate, zinc stearate and calcium stearate; flouropolymers; graphite; hydrocarbon waxes, silicones and the like. Further examples are disclosed in U.S. Pat. Nos. 6,312,795 and 6,784,255, the entire disclosures of which are incorporated herein by reference.

Desirably, the magnetic composition 24 in sheet 26 form is provided in a fluid condition wherein the magnetizable particles 25 are able to shift, rotate or otherwise change their orientation with respect to one another and with respect to other portions of the magnetic composition 24 and the environment. Upon exposure to an applied magnetic field, for example a field provided by a temperature controlled magnetic roller 12, the magnetizable particles 25 may move such that the magnetic poles of the particles 25 align with the applied magnetic field. The applied magnetic field is desirably maintained until the magnetic composition 24 sufficiently solidifies such that further movement of the particles 25 is prevented.

The sheet 26 of magnetic composition 24 may be exposed to an external or applied magnetic field provided by the temperature controlled magnetic roller 12. During the time that the magnetic composition 24 is in contact with the temperature controlled magnetic roller 12, heat may pass from the magnetic composition 24 to the temperature controlled magnetic roller 12, or vice versa depending upon the content of the magnetic composition 24, thereby expediting a solidification of the magnetic composition 24 to the extent that the particles 25 are no longer able to shift, such that the particles 25 will remain aligned subsequent to the removal of the external magnetic field.

The sheet 26 of magnetic composition 24 may contact the temperature controlled magnetic roller 12 at a contact point or line 16, remain in contact about a portion of the circumference of the temperature controlled magnetic roller 12, and cease contacting the roller 12 at a separation point or line 18. The arc length about the roller 12 between the contact point 16 and the separation point 18 may be any suitable arc length appropriate to achieve a proper contact or dwell time between the magnetic material and the roller 12 to provide for appropriate heat transfer and sufficient solidification of the magnetic composition 24 to form the finished magnetic sheet 20. In some embodiments, dwell time may range from 0.1 seconds to 4 seconds or more. Factors which influence the required dwell time include the temperature of the temperature controlled magnetic roller 12, the initial temperature of the magnetic composition 24, the types and quantities of the materials used in the magnetic composition 24, the thickness of magnetic sheet 26, the thickness, composition and properties of a substrate 42 and any other factors that may influence cooling time, such as ambient temperature, air flow across the sheet 26, etc. The diameter of the temperature controlled magnetic roller 12 and the web speed of the moving sheet 26 are additional factors which impact dwell time and thus influence the design of the apparatus. Desirably, the web speed of the moving sheet 26 may be relatively high, such as 75 feet per minute or more. In some embodiments, the web speed may be even faster, such as 200 feet per minute or more, or even 300-400 feet per minute.

A temperature controlled magnetic roller 12 may be of any suitable size, having any desired length and diameter. In some embodiments, the outer diameter of the temperature controlled magnetic roller 12 may be at least 5". In some embodiments, the outer diameter of the temperature controlled magnetic roller 12 may be 13" or more. In some embodiments, the outer diameter of the temperature controlled magnetic roller 12 may be as large as 24", 26" and even 30".

In some embodiments, a release film (not shown) such as silicone coated paper, polyester or silicone coated polyester may be inserted between the magnetic composition 24 and the temperature controlled magnetic roller 12 to prevent the magnetic composition 24 from sticking to the roller 12. The release film may be recollected after the separation point 18. In some embodiments, the temperature controlled magnetic roller 12 may be coated with a release coating, such as silicone, silicone rubber, or other non-adhering to the magnetic material, wax, parylene, Teflon®, polyester and/or the like to prevent the magnetic composition 24 from sticking to the roller 12.

Figure 2:
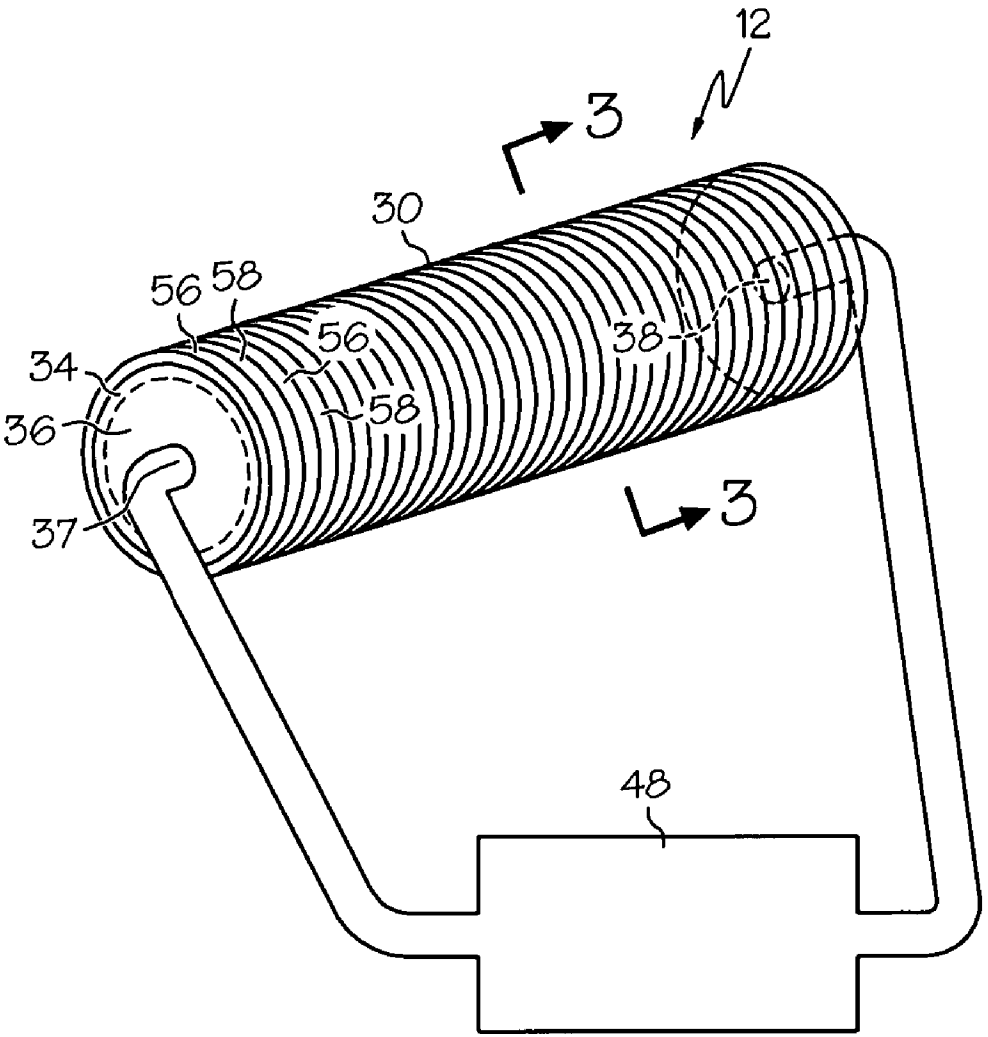
FIG. 2 depicts an embodiment of a temperature controlled magnetic roller.
Figure 3:
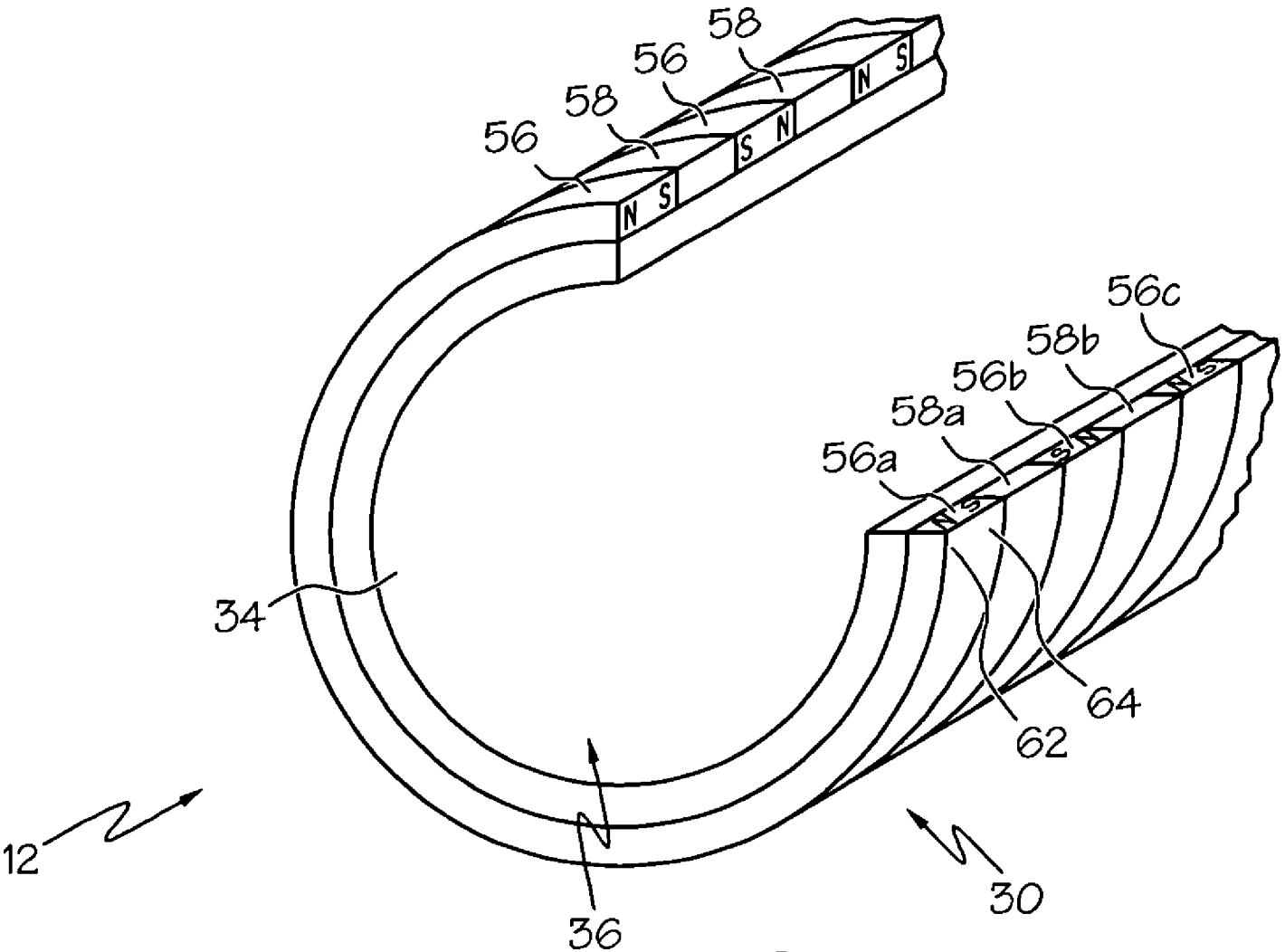
FIG. 3 shows a partial sectional view of an embodiment of a temperature controlled magnetic roller.

Referring to FIGS. 1-3, in some embodiments, the temperature controlled magnetic roller 12 may comprise a magnetized outer surface 30 and a cylindrical body portion 34 having an internal chamber 36. The magnetized outer surface 30 may comprise a plurality of alternating North and South magnetic poles. The alternating poles may be arranged according to any suitable configuration. In some embodiments, the North and South poles may extend about the circumference of the roller and may alternate along the length of the roller 12. For example, various embodiments of a roller 12 may contain 12 to 32 alternating poles per inch as measured in the lengthwise direction. Other embodiments may include lesser or greater alternating pole density. Further, some embodiments may contain multiple regions, and each region may include a distinct alternating pole arrangement and/or alternating pole density. Some examples of magnetic pole arrangements are disclosed in U.S. Pat. Nos. 3,127,544; 3,206,655; 4,292,261; 4,379,276; 5,107,238; 5,424,703; 6,190,573; and 6,304,162; the entire disclosures of which are incorporated herein by reference in their entireties.

The internal chamber 36 may be in fluid communication with a first aperture 37 which may comprise an inlet port and a second aperture 38 which may comprise an outlet port. The first aperture 37 and the second aperture 38 may be in fluid communication with a temperature control system 48. A fluid, such as air, water, distilled or deionized water, corrosion inhibited mixtures, oils or any other suitable fluid capable of heat transfer may circulate throughout the internal chamber 36 and the temperature control system 48, and may impart heat to or remove heat from the temperature controlled magnetic roller 12. The temperature control system 48 may maintain the temperature controlled magnetic roller 12 at a predetermined temperature.

A temperature control system 48 may include any components necessary and/or desirable for controlling the temperature of a circulating fluid. For example, a temperature control system 48 may include a thermostat, a logic control circuit, a pump, a heating element, a radiator and any other suitable components.

In some embodiments, the temperature controlled magnetic roller 12 may comprise a cylindrical body 34 having an internal chamber 36, and a plurality of magnets 56 oriented on or about the cylindrical body 34. For example, the magnets 56 may comprise neodymium ferrite magnets. The magnets 56 may be made from any other suitable magnetic material, such as samarium cobalt, barium ferrite, strontium and/or lead ferrite, Alnico, etc. The composition of the magnets 56 may be chosen according to the required strength of the magnetic field generated by the temperature controlled magnetic roller 12. The magnetic flux of the magnetic field desirably exceeds the magnetic flux required to permanently magnetize the magnetic composition 24. Thus, the required strength of the magnetic field of the temperature controlled magnetic roller 12 is dependent upon the composition of the magnetic composition 24. In some embodiments, the magnets 56 may comprise high strength permanent magnets which provide 3000 gauss or more of magnetic flux density.

In some embodiments, the magnets 56 may comprise rings that extend about the periphery of the cylindrical body 34.

Magnets 56 may be of any suitable shape and size. In some embodiments, the thickness of a ring magnet 56 (or distance between an outer diameter surface and an inner diameter surface) may range from ⅛" to 1".

In some embodiments, adjacent magnets 56 may be separated by pole pieces 58. Desirably, the pole pieces 58 are made from a material having relatively high magnetic permeability, such as soft iron, iron-cobalt alloys, permalloy, iron-nickel alloys, silicon, silicone steel, carbon steel and/or other soft ferrites or various combinations of these materials.

FIG. 3 shows a sectional view of an embodiment of a temperature controlled magnetic roller 12 having alternating ring magnets 56 and pole pieces 58 along its length. The magnets 56 and pole pieces 58 may be secured to the cylindrical body 34 of the roller 12 using any suitable type of connection, such as an adhesive.

The cylindrical body 36 may be any suitable size and may be made from any suitable materials. Desirably, the cylindrical body 36 may be made from a high strength material having high thermal conductivity, such as a metal. The use of a material having high thermal conductivity allows for rapid heat transfer between the outer surface of the temperature controlled magnetic roller 12 and the temperature controlling fluid circulating through the internal chamber 36. The use of a high strength material allows the cylindrical body 36 to be provided with a relatively thin wall portion.

In one embodiment, the cylindrical body 36 may comprise an aluminum cylinder having a thickness of ½", an inner diameter of 10.5" and an outer diameter of 11.5". The magnets 56 and pole pieces 58 may have a thickness of ¼", an inner diameter of 11.5" and an outer diameter of 12", thereby forming a roller 12 which has a 12" outer diameter and desirably a smooth continuous outer surface.

The magnetic poles of the magnets 56 may be arranged in any suitable configuration to form a magnetic field which may be used to magnetize the sheet 26 of magnetic composition 24 adjacent to the roller 12. In one embodiment, each magnet 56 may be magnetized across its height direction (parallel to the longitudinal axis of the roller 12), such that a first side 62 of the magnet 56 may have a first polarity, such as North, and a second side 64 of the magnetic ring may have an opposite polarity, such as South.

Figure 4:
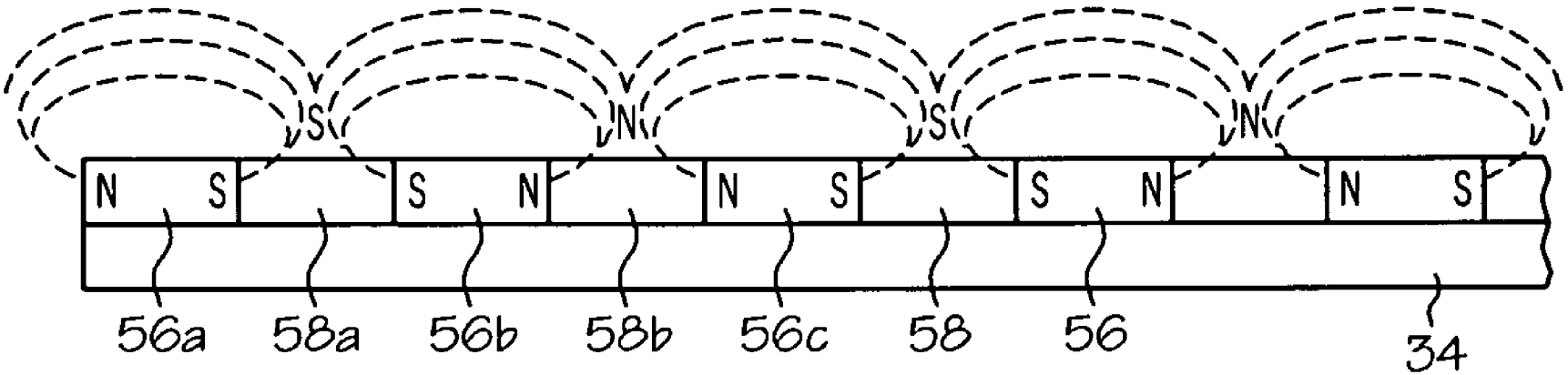
FIG. 4 shows a sectional view of a wall portion of an embodiment of a temperature controlled magnetic roller.

The orientation of the North and South poles of the magnets 56 may reverse between adjacent magnets 56. Thus, for example as shown in FIGS. 3 and 4, a first pole piece **58*a* may be situated between a first magnet 56*a* and a second magnet 56*b*. The magnets 56*a*, 56*b* may be oriented such that the side of each magnet 56*a*, 56*b* which abuts the first pole piece 58*a* has the same polarity, such as South. A second pole piece 58*b*, adjacent to the first pole piece 58*a*, may be situated between the second magnet 56*b* and a third magnet 56*c*. The magnets 56*b*, 56*c* may be oriented such that the side of each magnet 56*b*, 56*c* which abuts the second pole piece 58*b* has the same polarity, such as North. This configuration of magnets 56 and pole pieces 58 creates a magnetic flux pattern extending from the surface of the roller 12 having alternating magnetic poles centered upon the pole pieces 58, as shown in FIG. 4. In some embodiments, each of the magnets 56 and pole pieces 58 may have a height dimension (parallel to the longitudinal axis of the roller 12) of 1/32", thereby imparting 16 alternating North and South poles per inch to the temperature controlled magnetic roller 12 as measured along its length. Various embodiments may be arranged for higher or lower alternating polarity density along the length of the roller 12**.

Figure 5:
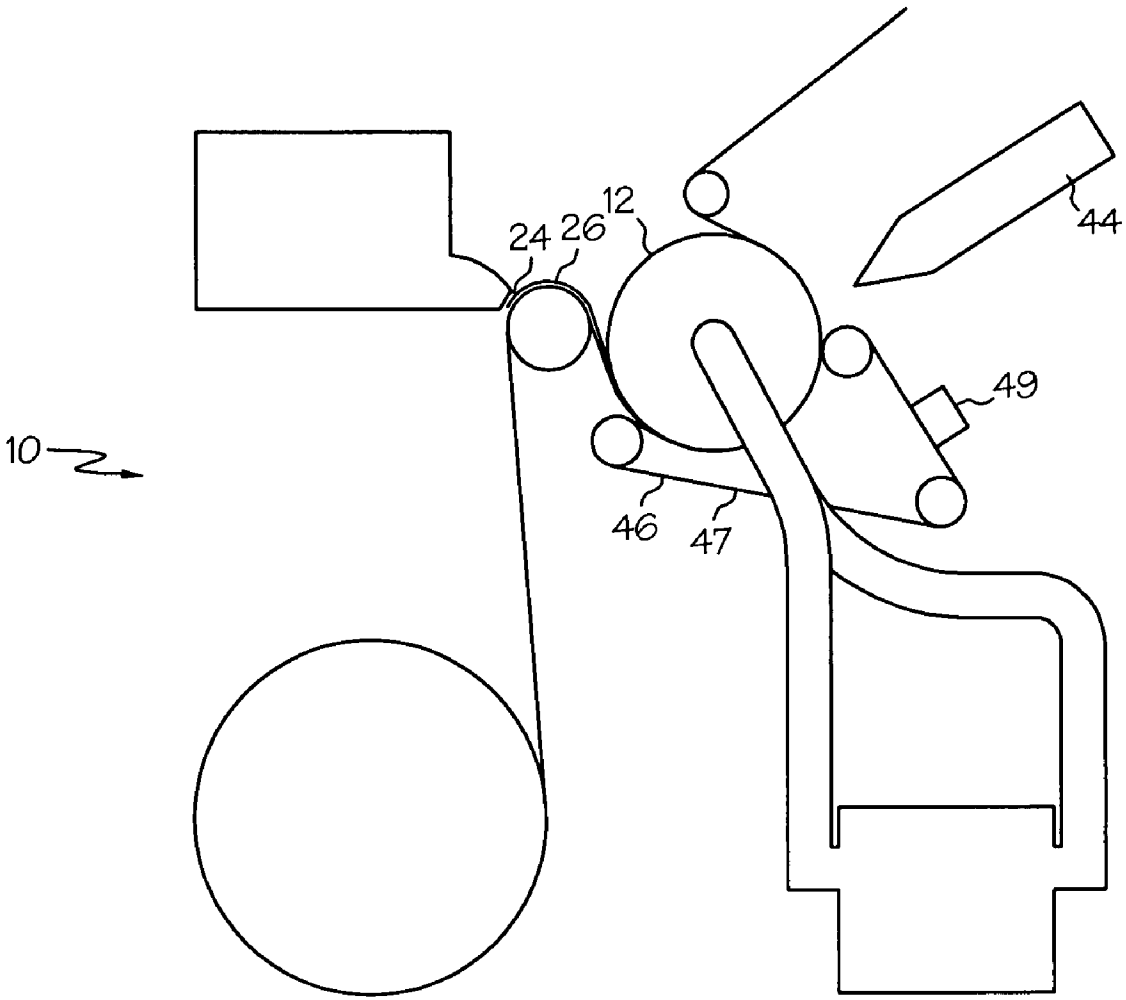
FIG. 5 shows another embodiment of a coating machine having a temperature controlled magnetic roller.

FIG. 5 shows another embodiment of a magnetic coating machine 10 having a temperature controlled magnetic roller 12. While a first side of the sheet 26 of magnetic composition 24 may contact the temperature controlled magnetic roller 12, additional devices may be used to act upon the second side of the sheet 26 to impart a greater temperature change in the allotted time frame. An air handling device 44, such as a fan, may be used to direct flowing gases across the second side of the sheet 26. The air handling device 44 may include cooling elements or heating elements in order to provide gases at a predetermined desired temperature. In some embodiments, an air handling device may receive gases at a predetermined desired temperature from another source.

Another method of providing a greater temperature change to the sheet 26 may comprise contacting the second side of the sheet 26 with a device 46 arranged to remove or add heat, such as a belt 47. The surface of a belt 47 which contacts the second side of the sheet 26 may be moving at the same speed as the sheet 26. The belt 47 may be oriented to contact the second side of the sheet 26 throughout any portion of the circumference of the temperature controlled magnetic roller 12. In some embodiments, a belt 47 may be operated upon by a temperature control device 49 which may restore the temperature of the belt 47 to a predetermined temperature after the belt 47 has imparted heat to or removed heat from the sheet 26.

In some embodiments, the device 46, such as a belt 47, may be made from a non-magnetically attractive material, such as aluminum, stainless steel, brass, copper, bronze, or the like. Such a belt 47 may function as a heatsink.

In some embodiments, the device 46, such as a belt 47, may be made from a material having high magnetic permeability. For example, a belt 47 made from ferritic materials or other materials having high magnetic permeability may help to channel the magnetic field generated by the temperature controlled magnetic roller 12 and further enhance the magnetic strength imparted to the magnetic composition 24.

Figure 6:
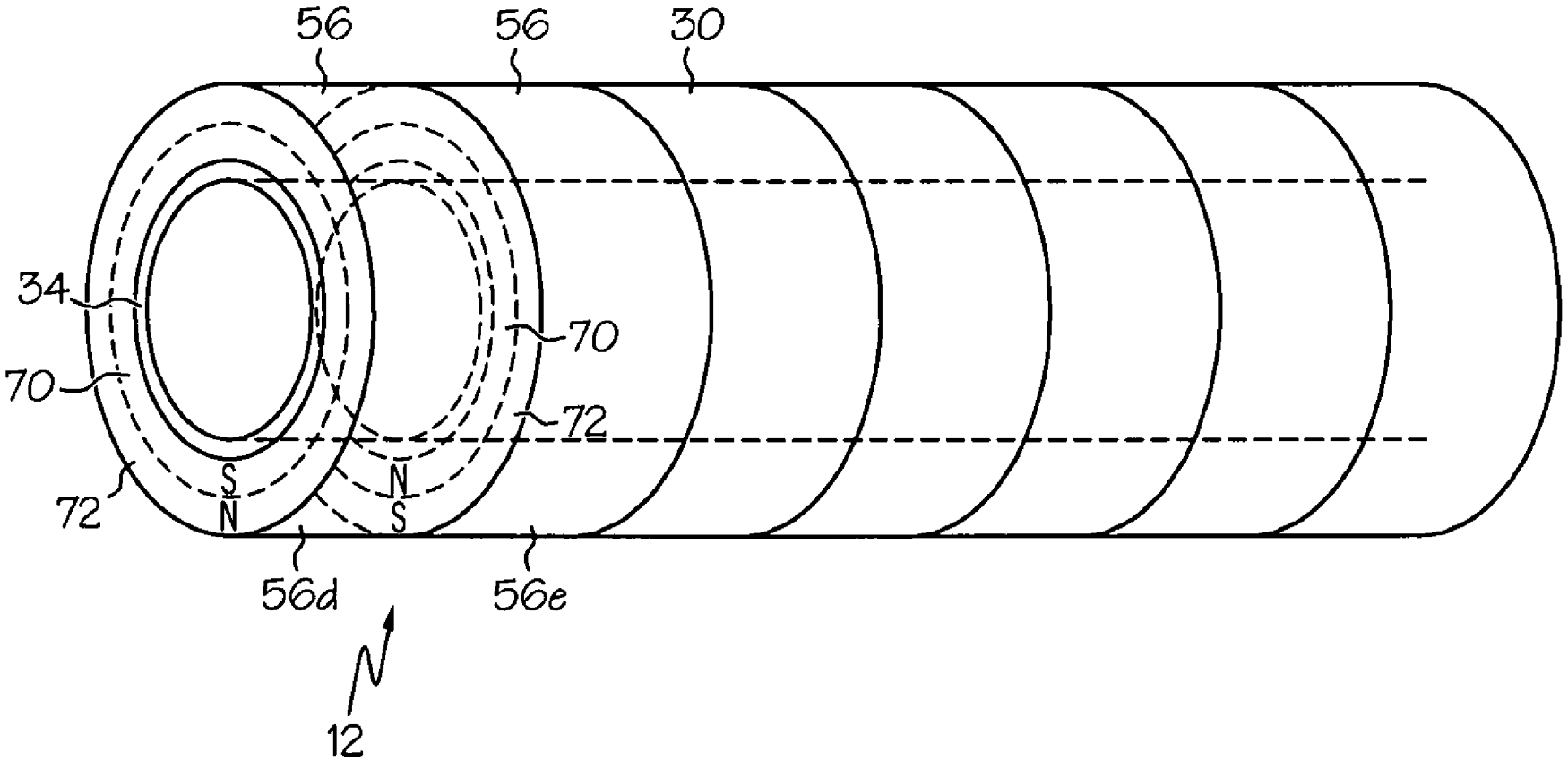
FIG. 6 shows another embodiment of a temperature controlled magnetic roller.

FIG. 6 shows another embodiment of a temperature controlled magnetic roller 12 which may comprise a cylindrical body portion 34 and a plurality of magnets 56. The magnets 56 may comprise ring magnets oriented about the circumference of the cylindrical body portion 34. Each magnet 56 may be polarized such that the North and South magnetic poles each extend about a circumferential portion of the magnet 56 and are oriented concentrically with respect to one another. Thus, each magnet 56 may comprise an inner pole 70 and an outer pole 72, wherein the outer pole 72 is oriented concentrically outwardly from the inner pole 70. For example, magnet 56*d* may be polarized such that the inner pole 70 comprises a South pole and the outer pole 72 comprises a North pole.

Adjacent magnets 56 may be arranged such that the orientation of the magnetic polarity reverses with respect to one another. For example, a magnet 56*e*, which is adjacent to magnet 56*d*, may be polarized such that the inner pole 70 comprises a North pole and the outer pole 72 comprises a South pole. The alternating polarity orientation between adjacent magnets 56 provides the magnetized outer surface 30 of the temperature controlled magnetic roller 12 with alternating North and South poles along its length.

The magnets 56 may be of any suitable dimensions and are desirably arranged to provide the temperature controlled magnetic roller 12 with a high number of alternating poles along its length. For example, the roller 12 may be arranged to have 12 to 32 or more alternating poles per inch as measured in the lengthwise direction of the roller 12.

Figure 7:
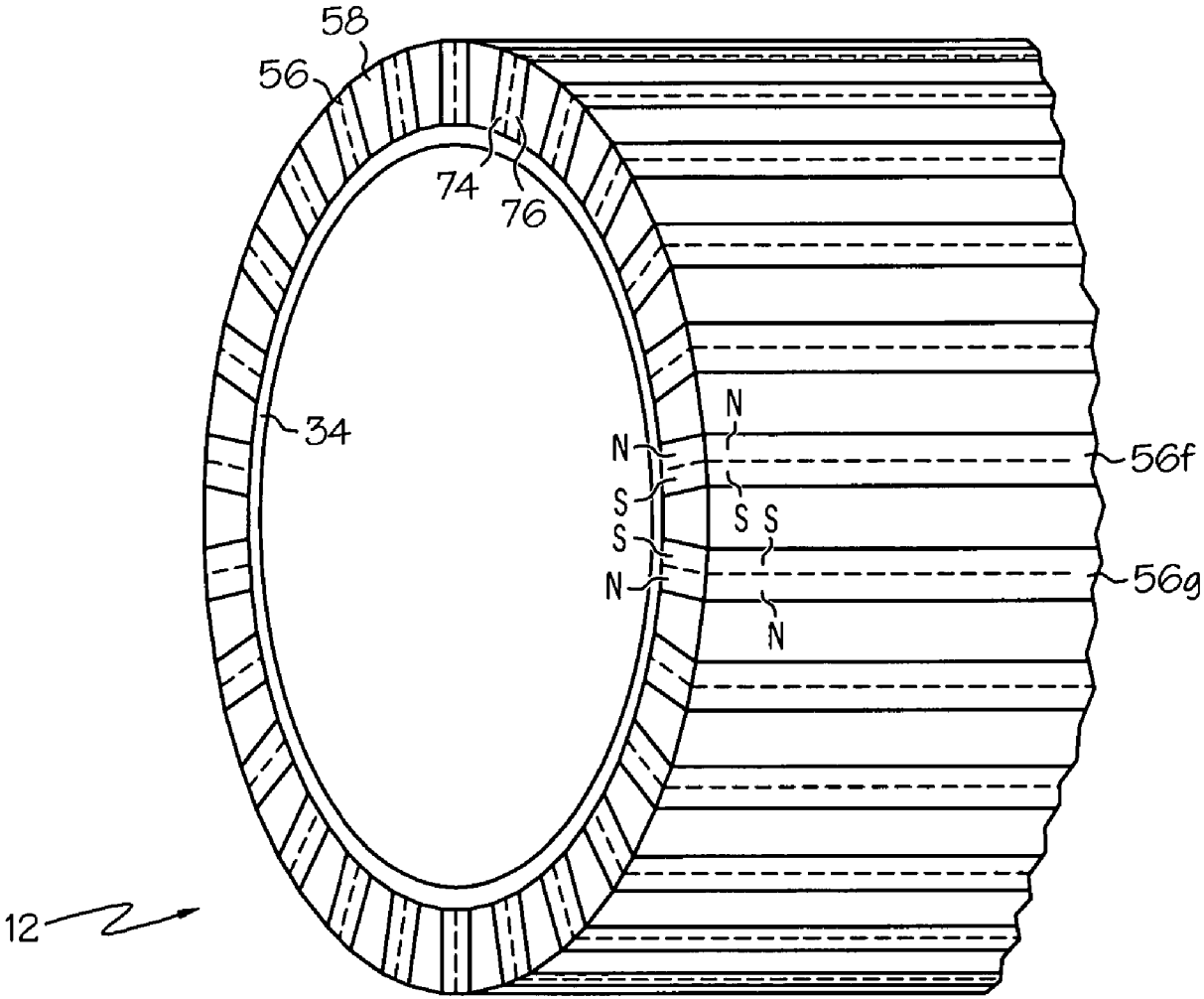
FIG. 7 shows another embodiment of a temperature controlled magnetic roller.

FIG. 7 shows another embodiment of a temperature controlled magnetic roller 12 which may comprise a cylindrical body portion 34, a plurality of magnets 56 and a plurality of pole pieces 58. The magnets 56 may comprise bar magnets which extend at least a portion of the length of the temperature controlled magnetic roller 12. In some embodiments, the magnets 56 may extend the entire length of the temperature controlled magnetic roller 12.

The pole pieces 58 may comprise any suitable material and desirably are made from a material having relatively high magnetic permeability. The pole pieces 58 may extend in the lengthwise direction of the temperature controlled magnetic roller 12. The magnets 56 and pole pieces 58 may be arranged to alternate about the periphery of the temperature controlled magnetic roller 12 in a circumferential direction.

Each magnet 56 may be polarized such that a first lengthwise portion 74 of the magnet 56 comprises a first polarity and a second lengthwise portion 76 of the magnet 56 comprises a second polarity. The first length wise portion 74 may be oriented circumferentially adjacently from the second lengthwise portion 76.

Adjacent magnets 56 may be arranged such that the orientation of the magnetic polarity reverses with respect to one another. For example, a first magnet 56*f* may be polarized such that the first lengthwise portion 74 comprises a North pole, while the second lengthwise portion 76 comprises a South pole. An adjacent second magnet 56*g* may be polarized such that the first lengthwise portion 74 comprises a South pole, while the second lengthwise portion 76 comprises a North pole. The alternating polarity orientation between adjacent magnets 56 provides the magnetized outer surface 30 of the temperature controlled magnetic roller 12 with alternating North and South poles about its circumference.

Various embodiments of the temperature controlled magnetic roller 12 may be provided with any desirable number of magnetic poles about its circumference. For example, in preferred embodiments, a roller 12 may have 10 to 32 magnetic poles per inch about its circumference. In some embodiments, the roller 12 may have less than 10 or greater than 32 poles per inch about its circumference.

As shown in FIG. 7, in some embodiments, the magnets 56 may have a square or rectangular cross-sectional shape, while the pole pieces 58 may have a trapezoidal cross-sectional shape.

In some embodiments, the pole pieces 58 may comprise a portion of the cylindrical body portion 34. For example, the body portion 34 may begin as a cylindrical piece of material, and slots to receive the magnets 56 may be machined into the outer surface of the body portion 34.

In some embodiments, the magnets 56 may have a trapezoidal cross-sectional shape, and the pole pieces 58 may have a square or rectangular cross-sectional shape. In some embodiments, both the magnets 56 and the pole pieces 58 may have a trapezoidal cross-sectional shape. In some embodiments, both the magnets 56 and the pole pieces 58 may have a square or rectangular cross-sectional shape. Remaining gaps which may be present between adjacent magnets 56 and pole pieces 58 may be filled with epoxy filler, alignment shims having a triangular cross-sectional shape, or any other suitable method. Desirably, the outer surface of each of the magnets 56 and the pole pieces 58 may include appropriate curvature to impart a smooth circumference to the outer surface of the temperature controlled magnetic roller 12.

Figure 8:
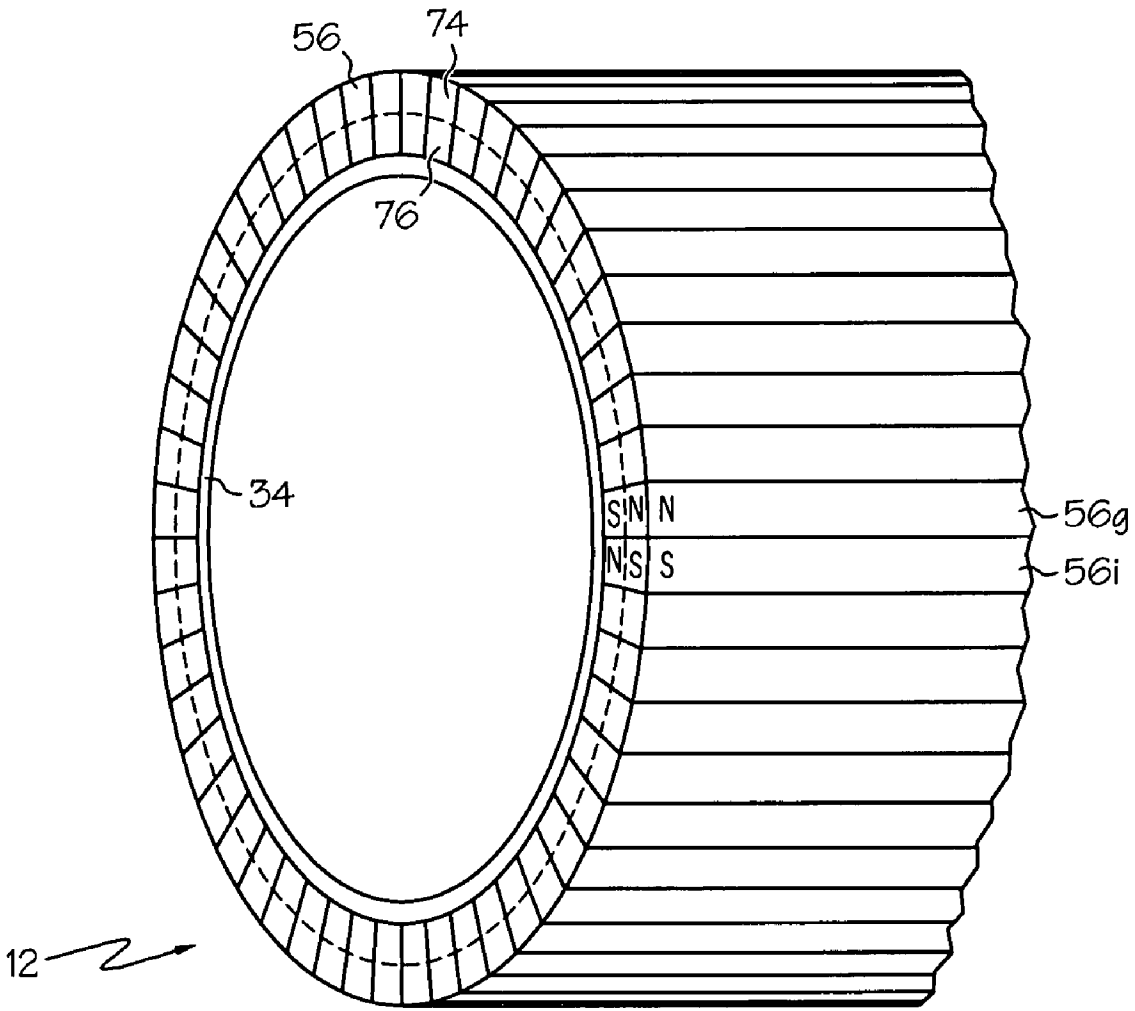
FIG. 8 shows another embodiment of a temperature controlled magnetic roller.

FIG. 8 shows another embodiment of a temperature controlled magnetic roller 12 which may comprise a cylindrical body portion 34 and a plurality of magnets 56. The magnets 56 may comprise bar magnets which extend at least a portion of the length of the temperature controlled magnetic roller 12. In some embodiments, the magnets 56 may extend the entire length of the temperature controlled magnetic roller 12.

Each magnet 56 may be polarized such that a first lengthwise portion 74 of the magnet 56 comprises a first polarity and a second lengthwise portion 76 of the magnet 56 comprises a second polarity. The first length wise portion 74 may be oriented radially outwardly from the second lengthwise portion 76.

Adjacent magnets 56 may be arranged such that the orientation of the magnetic polarity reverses with respect to one another. For example, a first magnet 56*h* may be polarized such that the first lengthwise portion 74 comprises a North pole, while the second lengthwise portion 76 comprises a South pole. An adjacent second magnet 56*i* may be polarized such that the first lengthwise portion 74 comprises a South pole, while the second lengthwise portion 76 comprises a North pole. The alternating polarity orientation between adjacent magnets 56 provides the magnetized outer surface 30 of the temperature controlled magnetic roller 12 with alternating North and South poles about its circumference.

In some embodiments, each magnet 56 may have a trapezoidal cross-sectional shape. In some embodiments, the cross-sectional shape of the magnets 56 may change between adjacent magnets 56. For example, magnets 56 wherein the first lengthwise portion 74 comprises a North pole may include a square or rectangular cross-sectional shape, while magnets 56 wherein the first lengthwise portion 74 comprises a South pole may include a trapezoidal cross-sectional shape, or vice versa.

In some embodiments, all of the magnets 56 may have a square or rectangular cross-sectional shape. Remaining gaps which may be present between adjacent magnets 56 may be filled with an epoxy filler, alignment shims having a triangular cross-sectional shape, or any other suitable method or device. Desirably, the outer surface of each of the magnets 56 may include appropriate curvature to impart a smooth circumference to the outer surface of the temperature controlled magnetic roller 12.

The invention also contemplates methods or processes of forming a magnetic sheet using a temperature controlled magnetic roller 12. Embodiments of example processes will be discussed with respect to magnetic material having thermoplastic binders, thermosetting binders and self-setting binders.

Magnetic Material Which Includes Thermoplastic Binders

When the magnetic composition 24 comprises magnetic particles 25 and a thermoplastic binder, the magnetic composition 24 may be provided in sheet 26 form at a relatively high temperature above the softening point, wherein the thermoplastic material may be in a molten, flowable or pliable state. Examples of magnetic materials including one or more thermoplastics are disclosed in Published US Application No. 20020081446A1 (U.S. patent application Ser. No. 09/990,109), the entire disclosure of which is incorporated herein by reference. In some embodiments, the magnetic composition 24 may be provided at temperatures of 275° F. (135° C.) to 350° F. (approx. 177° C.) and higher. The exact temperatures required to cause pliability are generally dependent upon the specific composition of the magnetic composition 24 being used.

The pliable thermoplastic magnetic composition 24 sheet 26 may pass the contact point 16 and be in contact with the temperature controlled magnetic roller 12. The magnetic particles 25 within the magnetic composition 24 may immediately shift their orientation to align with the magnetic field provided by the temperature controlled magnetic roller 12.

The temperature controlled magnetic roller 12 may be maintained at a predetermined temperature that is desirably lower than the temperature at which the thermoplastic material in the magnetic composition 24 will solidify. In some embodiments, the temperature controlled magnetic roller 12 may be maintained having an external surface temperature ranging from 40° F.-150° F.

Desirably, the temperature of the outer surface of the temperature controlled magnetic roller 12 may be controlled to a temperature that is above the dew point of the ambient air to avoid condensation on the roller 12 surface. In some embodiments, the temperature may be controlled to be slightly less than the dew point of the ambient air to induce a minimal condensation on the roller 12 surface. A minimal condensation may be used to prevent the magnetic sheet 26 from sticking to the roller 12, and thus the use of a release coating on either the sheet 26 and/or the roller 12 can be avoided.

The external surface temperature of the temperature controlled magnetic roller 12 may be controlled by maintaining the fluid of the temperature control system 48 at a predetermined temperature. In some embodiments, the fluid entering the internal chamber 36 of the temperature controlled magnetic roller 12 may be provided at temperatures of 35° F., 40° F., 50° F., 60° F. and higher.

During the time in which the magnetic composition 24 is in contact with the temperature controlled magnetic roller 12, heat may be transferred from the magnetic composition 24 to the temperature controlled magnetic roller 12. Desirably the temperature of the magnetic composition 24 lowers sufficiently to cause solidification of the thermoplastic material to the point that the magnetic particles 25 are unable to shift, and thus remain permanently aligned according to the applied magnetic field. Desirably the proper temperature change occurs before the separation point 18, wherein the magnetic composition 24 ceases to contact the temperature controlled magnetic roller 12. In some embodiments, the temperature of the magnetic composition 24 at the separation point 18 is 220° F. (approx. 105° C.) or less. The exact temperatures required to cause sufficient solidification are generally dependent upon the specific composition of the magnetic composition 24 being used.

Testing

The inventive apparatus and method was tested against a conventional prior art method of forming a magnetic sheet. The inventive apparatus and method yielded a significantly stronger magnetic sheet.

The prior art method utilized a conventional 2" roller having alternating neodymium magnets and steel pole pieces, arranged to impart 16 poles per inch along the length of the prior art roller. The prior art roller was used to magnetize 0.004" (approx. 0.0098 cm) and 0.006" (approx. 0.0152 cm) thick coatings of a magnetic material comprising a thermoplastic binder with magnetic particles on a 0.005" (0.0127 cm) paper substrate. The magnetic material was magnetized by the prior art roller at ambient temperature (unaligned magnetic particles).

The inventive method utilized a 13" (approx. 33 cm) diameter temperature controlled magnetic roller 12 having internal heat exchange fluid. The temperature controlled magnetic roller 12 comprised alternating neodymium magnets 56 and steel pole pieces 58, arranged to impart 16 poles per inch along the length of the roller 12. The same material that was used to make the magnetic rings and pole pieces of the inventive roller was used to make the respective magnets and pole pieces of the prior art roller, and thus the strength of the magnetic field generated by the temperature controlled magnetic roller 12 was substantially the same as the strength of magnetic field generated by the prior art roller. Both the temperature controlled magnetic roller 12 and the prior art roller provided a magnetic field of sufficient strength to achieve magnetic saturation of the magnetic sheet.

The temperature controlled magnetic roller 12 was used to magnetize 0.004" (approx. 0.0098 cm) and 0.006" (approx. 0.0152 cm) thick coatings of a thermoplastic binder with magnetic particles on a 0.005" (0.0127 cm) paper substrate. A 1½ mill thick release paper was applied between the roller 12 and the surface of the magnetic composition 24 sheet 26. The initial temperature of the release film coating contacting the temperature controlled magnetic roller 12 was 254° F. (approx. 123° C.). The web speed of the sheet 26 was 150 ft/min. The contact arc between the contact point 16 and the separation point 18 about the circumference of the temperature controlled magnetic roller 12 was 180°. The surface temperature on the back side of the paper substrate leaving the temperature controlled magnetic roller 12 after the separation point was 162° F. (approx. 72° C.). The computed contact time between the sheet 26 and the temperature controlled magnetic roller 12 was 0.8 seconds.

Strength of Magnetic Sheet Testing

| Thickness | Prior art method (ambient temperature - unaligned) Magnetic strength (grams/sq. in) | Inventive method (pliable temperature - aligned) Magnetic strength (grams/sq. in) |
|---|---|---|
| 0.004" | 1.5 | 2.8 |
| 0.006" | 1.9 | 3.3 |

The 0.004" thick magnetic sheet made using the inventive apparatus and method was approximately 87% stronger than the 0.004" thick magnetic sheet made using the prior art method. The 0.006" thick magnetic sheet made using the inventive apparatus and method was approximately 74% stronger than the 0.006" thick magnetic sheet made using the prior art method. The 0.004" thick magnetic sheet made using the inventive apparatus and method was approximately 47% stronger than the 0.006" thick magnetic sheet made using the prior art method.

Magnetic Material Which Includes Thermosetting Binders

Solidification of a thermoset material typically occurs as a result of a chemical reaction. "Thermoset" is a term of art broadly used to refer to polymeric materials that solidify or set irreversibly, the phenomenon of which is associated with a polymerization or cross-linking of the constituents which may be induced by heat, radiation or chemical means. "Thermoset" may be broadly construed to include moisture curing, radiation curing, single and multiple part systems, condensation, free radical systems, oxidative cures, thermal setting materials, etc. Examples include, but are not limited to, epoxies, polyurethanes, polyureas, polyurethane/polyurea hybrids, cyanoacrylates, silicones (polysiloxanes), polyesters, acrylics, etc.

In some embodiments, heat may be applied to break down an inhibitor, thereby allowing the thermoset to solidify. In some embodiments, heat may accelerate the chemical reaction which causes solidification. Various compositions of thermoset materials may be formulated to cure at temperatures substantially above ambient, such as 50° C., 80° C., 120° C. and even 150° C. and higher.

When the magnetic composition 24 comprises magnetic particles 25 and a thermoset binder, the magnetic composition 24 may be provided in sheet 26 form at any desired temperature. In some embodiments, the sheet 26 may be provided at ambient temperature. In some embodiments, individual components of the thermoset binder may be mixed together immediately prior to formation of the sheet 26 and exposure to the temperature controlled magnetic roller 12.

The pliable thermoset magnetic composition 24 sheet 26 may pass the contact point 16 and may subsequently be in contact with the temperature controlled magnetic roller 12. The magnetic particles 25 within the magnetic composition 24 may immediately shift their orientation and align with the magnetic field provided by the temperature controlled magnetic roller 12.

The temperature controlled magnetic roller 12 may be maintained at a predetermined temperature that is desirably higher than ambient. In some embodiments, the temperature controlled magnetic roller 12 may be maintained at temperatures of 100° F.-260° F. and higher. The temperature of the temperature controlled magnetic roller 12 may range up to any desirable temperature, however, the temperature desirably will not be controlled to a temperature that is high enough to cause the magnets 56 to lose magnetization.

During the time in which the magnetic composition 24 is in contact with the temperature controlled magnetic roller 12, heat may be transferred from the temperature controlled magnetic roller 12 to the magnetic composition 24. Desirably, the temperature controlled magnetic roller 12 imparts sufficient heat to the magnetic composition 24 to induce or accelerate a chemical reaction of the thermoset binder such that the thermoset will solidify to the point that the magnetic particles 25 are unable to shift, and thus remain permanently aligned according to the applied magnetic field. Desirably, sufficient solidification will occur before the separation point 18, wherein the magnetic composition 24 ceases to contact the temperature controlled magnetic roller 12.

Magnetic Material Which Includes Self-setting Binders

In some embodiments, a magnetic composition 24 may comprise magnetic particles and a self-setting binder. A self-setting binder may cure or solidify as a result of a chemical reaction. A self-setting binder may solidify during the passage of a setting period which may begin when the components of the self-setting binder are mixed together.

Some examples of materials that may comprise self-setting binders are polyesters, epoxies, polyurethanes, cyanoacrilate such as Eastman 910® cyanoacrilate, and/or any other type of self-setting adhesive. Preferably, a self-setting binder may be quick setting. Further examples may be found in U.S. Pat. No. 6,693,506, the entire disclosure of which is incorporated herein by reference. In some embodiments, the mixture may further include a catalyst or accelerant to decrease the setting period.

When the magnetic composition 24 comprises magnetic particles 25 and a self-setting binder, the magnetic composition 24 may be provided in sheet 26 form at any desired temperature. In some embodiments, the sheet 26 may be provided at ambient temperature. In some embodiments, individual components of the self-setting binder may be mixed together immediately prior to formation of the sheet 26 and exposure to the roller 12.

The pliable self-setting magnetic composition 24 sheet 26 may pass the contact point 16 and may subsequently be in contact with the roller 12. The magnetic particles 25 within the magnetic composition 24 may immediately shift their orientation and align with the magnetic field provided by the temperature controlled magnetic roller 12.

Desirably, the self-setting binder will sufficiently solidify such that that the magnetic particles 25 are unable to shift, and thus remain permanently aligned according to the applied magnetic field, prior to the sheet 26 leaving the roller 12 at the separation point 18.

In some embodiments, a temperature controlled magnetic roller 12 may be arranged to add heat to, or remove heat from, the magnetic composition 24 during the setting period of the self-setting binder. In some embodiments, this may increase or may decrease the length of the setting period.

The invention also contemplates methods of forming a magnetic sheet using a temperature controlled magnetic roller 12 as described in the following enumerated paragraphs:

1. A method of making a magnetic sheet comprising:
   providing a sheet of magnetizable material comprising magnetizable particles and a binder, wherein said binder is in a pliable state;
   providing a magnetic roller having a temperature control system, said magnetic roller having a magnetizing field;
   running said sheet of magnetizable material adjacent to said roller such that the magnetizable particles align with said magnetizing field and heat is transferred between said sheet and said roller;
   maintaining said sheet adjacent to said roller for a period of time sufficient for said binder to sufficiently solidify such that said magnetizable particles are unable to shift orientation.
2. The method of making a magnetic sheet according to paragraph 1, wherein said binder comprises a thermoplastic material.
3. The method of making a magnetic sheet according to paragraph 2, wherein said roller removes heat from said sheet.
4. The method of making a magnetic sheet according to paragraph 3, wherein the sheet is initially provided at a temperature above a softening point of said thermoplastic material.
5. The method of making a magnetic sheet according to paragraph 4, wherein said roller cools said sheet to a temperature below said softening point of said thermoplastic material.
6. The method of making a magnetic sheet according to paragraph 3, wherein the temperature of said roller is maintained at a predetermined temperature that is below said softening point of said thermoplastic material.
7. The method of making a magnetic sheet according to paragraph 2, wherein heat transfer between said sheet and said roller begins at a contact point and ends at a separation point, and said thermoplastic material solidifies prior to reaching the separation point.
8. The method of making a magnetic sheet according to paragraph 1, wherein said binder comprises a thermosetting material.
9. The method of making a magnetic sheet according to paragraph 8, wherein said roller imparts heat to said sheet.
10. The method of making a magnetic sheet according to paragraph 9, wherein the heat imparted to said sheet breaks down an inhibitor in said thermosetting material and causes said thermosetting material to set.
11. The method of making a magnetic sheet according to paragraph 9, wherein the heat imparted to said sheet accelerates a reaction which causes said thermosetting material to set.
12. The method of making a magnetic sheet according to paragraph 9, wherein the temperature of said roller is maintained at a predetermined temperature above an ambient temperature.
13. The method of making a magnetic sheet according to paragraph 8, wherein heat transfer between said sheet and said roller begins at a contact point and ends at a separation point, and said thermosetting material sets prior to reaching the separation point.
14. The method of making a magnetic sheet according to paragraph 1, wherein a fluid capable of heat transfer flows through said roller and said temperature control system.
15. The method of making a magnetic sheet according to paragraph 1, wherein the roller is maintained at a predetermined temperature.
16. An in-line process of magnetizing a magnetizable composition in a film form, the film having a first side and a second side, the composition comprising at least one thermoplastic material and at least one magnetizable material comprising magnetizable particles, the method comprising:
   using a magnetized roller to apply a magnetizing field to said magnetizable composition in film form when said magnetizable composition is at a temperature sufficient to render said magnetizable composition sufficiently fluid to allow said magnetizable particles to align with said magnetizing field; and
   cooling said magnetizable composition via heat transfer to the magnetized roller such that said magnetizable composition sufficiently solidifies to prevent dealignment of said magnetizable particles.
17. The process of paragraph 16 wherein said magnetizing field comprises a plurality of magnetic poles of alternating polarity per inch.
18. The process of paragraph 16 wherein the magnetizing field is applied to the first side of the film.
19. The process of paragraph 16 wherein the second side of said film is applied to a printable substrate at substantially the same time as said magnetizable composition in film form is exposed to said magnetizing field.
20. The process of paragraph 16, said magnetizing field comprising about 10 to about 30 poles of alternating polarity per inch.
21. The process of paragraph 16, said magnetizing field of a strength sufficient to permanently magnetize said particles.
22. The process of paragraph 16 wherein said cooling steps comprises cooling said magnetizable composition sufficiently such that said particles can no longer rotate.
23. The process of paragraph 16, said film has a thickness of 50 microns to 765 microns.
24. The process of paragraph 16 where the thin layer of thermoplastic material is a moving strip or sheet.
25. The process of paragraph 16 wherein said magnetic poles of alternating polarity are adjacent to one another.
26. The process of paragraph 16 wherein the magnetizing field is applied by a cooled magnetizing roll.
27. The process of paragraph 16 wherein the film is moving at a speed of at least 75 feet per minute.
28. The process of paragraph 16 wherein additional cooling is applied to the second side of the film during the cooling step.
29. The process of paragraph 18 where a ferromagnetic material is applied to a second side of the sheet during the cooling step.
30. The process of paragraph 16 wherein the magnetizable composition comprises about 70 wt-% to about 95 wt-% of said magnetizable material.
31. The process of paragraph 1 wherein said magnetizable composition is cooled by a magnetic roller.
32. Applying a magnetizing field to a first side of a thin layer of heat polymerizable fluid plastic material containing magnetizable material particles, said magnetizing field of sufficient strength to result in the permanent magnetizing of said particles, at a temperature where the plastic material is sufficiently fluid to allow rotation of the magnetizable material particles to align with the applied magnetic field, and heating the plastic material in the magnetizing field to a temperature where the polymerization of the plastic is complete and the particles can no longer rotate.

33. Applying a magnetizing field to a first side of a thin layer of a polymerizable plastic material containing a heat activated polymerizing agent and containing magnetizable material particles, said magnetizing field of sufficient strength to result in the permanent magnetizing of said particles, at a temperature where the polymerizable material is sufficiently fluid to allow rotation of the magnetizable material particles to align with the applied magnetic field and cooling the polymerizable material in the magnetizing field to a temperature where the particles can no longer rotate.

34. A method of making a magnetic sheet comprising:

providing a sheet of magnetizable material comprising magnetizable particles and a binder, wherein said binder is in a pliable state;

providing a magnetic roller having a magnetizing field;

running said sheet of magnetizable material adjacent to said roller such that the magnetizable particles align with said magnetizing field;

maintaining said sheet adjacent to said roller for a period of time sufficient for said binder to sufficiently solidify such that said magnetizable particles are unable to shift orientation.

35. The method of paragraph 34, further comprising transferring heat from said sheet to said magnetic roller.

36. The method of paragraph 34, further comprising transferring heat from said magnetic roller to said sheet.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A magnetizing roller comprising:

a roller having a magnetized outer surface having multiple magnetic poles, the roller further comprising an internal chamber;

a fluid arranged to circulate through said internal chamber; and a belt in proximity to the roller, the belt forming a closed loop, the belt positioned such that a sheet of magnetizable material in contact with the roller is sandwiched between the belt and the roller about a portion of a circumference of the roller.

2. The magnetizing roller of claim 1, further comprising a temperature control system, wherein said fluid circulates through said temperature control system.

3. The magnetizing roller of claim 2, wherein said fluid removes heat from said roller.

4. The magnetizing roller of claim 2, wherein said fluid imparts heat to said roller.

5. The magnetizing roller of claim 2, further comprising a belt temperature control device.

6. The magnetizing roller of claim 1, wherein said magnetized outer surface comprises a plurality of magnetic rings spaced along a longitudinal axis of said roller.

7. The magnetizing roller of claim 6, further comprising a plurality of pole pieces spaced along the longitudinal axis of said roller.

8. The magnetizing roller of claim 7, wherein said magnetic rings and said pole pieces alternate along the longitudinal axis of said roller.

9. The magnetizing roller of claim 8, wherein the roller includes sixteen magnetic rings per inch along the longitudinal axis.

10. The magnetizing roller of claim 8, wherein each magnetic ring includes a North pole and a South pole, and each magnetic ring is magnetized such that the North pole and the South pole extend about a circumference of the ring, and are oriented opposite one another in a direction parallel to the longitudinal axis of the roller.

11. The magnetizing roller of claim 10, wherein the orientation of the North pole and the South pole of a magnetic ring reverses between adjacent magnetic rings.

12. The magnetizing roller of claim 6, wherein said magnetic rings comprise a material selected from a group consisting of neodymium ferrite, samarium cobalt, barium ferrite, strontium ferrite and lead ferrite.

13. The magnetizing roller of claim 6, wherein a first magnetic ring is polarized such that an outer surface of the first magnetic ring comprises a North pole, a second magnetic ring is polarized such that an outer surface of the second magnetic ring comprises a South pole, the first magnetic ring being directly adjacent to the second magnetic ring.

14. The magnetizing roller of claim 1, wherein the magnetized outer surface comprises a plurality of magnetic poles alternating about a circumference of the roller.

15. The magnetizing roller of claim 14, wherein the magnetized outer surface comprises a plurality of strip magnets, a longitudinal axis of each strip magnet being parallel to a longitudinal axis of said roller.

16. The magnetizing roller of claim 15, wherein a first strip magnet is polarized such that an outer surface of the first strip magnet comprises a North pole, a second strip magnet is polarized such that an outer surface of the second strip magnet comprises a South pole, the first strip magnet being directly adjacent to the second strip magnet.

17. The magnetizing roller of claim 15, further comprising a plurality of pole pieces, wherein said strip magnets and said pole pieces alternate about a circumference of said roller.

18. The magnetizing roller of claim 1, wherein said fluid comprises water.

19. The magnetizing roller of claim 1, wherein the belt comprises a ferritic material.

20. The magnetizing roller of claim 1, wherein the belt spans between at least three belt rollers.

21. The magnetizing roller of claim 20, wherein two of said belt rollers are located immediately adjacent to the roller having a magnetized outer surface, and one of said belt rollers is spaced apart from the roller having a magnetized outer surface.

22. The magnetizing roller of claim 1, further comprising an air handling device arranged provide a flow of air at a predetermined temperature, the flow directed at the roller and at the belt.

23. A magnetizing roller comprising:

a roller comprising an internal chamber and a magnetized outer surface having multiple magnetic poles;

a temperature control system;

a fluid arranged to circulate throughout said temperature control system and said internal chamber; and a belt in proximity to the roller, the belt forming a closed loop, the belt comprising a ferritic material, the belt positioned such that a sheet of magnetizable material in contact with the roller is sandwiched between the belt and the roller about a portion of a circumference of the roller.

24. The magnetizing roller of claim 23, wherein the roller further comprises a cylindrical body portion and a plurality of magnetic rings disposed about the cylindrical body portion.

25. The magnetizing roller of claim 24, wherein the roller further comprises a plurality of ring shaped pole pieces disposed about the cylindrical body portion.

26. The magnetizing roller of claim 25, wherein said magnetic rings and said ring shaped pole pieces alternate along the length of said roller.

27. A coating machine comprising:

an extruder arranged to provide a continuous sheet of magnetizable material;

a magnetizing roller having a magnetized outer surface and an internal chamber, wherein a heat transfer fluid is arranged to circulate throughout said internal chamber;

a temperature control system in communication with said heat transfer fluid to maintain said magnetizing roller at a predetermined temperature; and a belt forming a closed loop, the belt arranged such that a portion of the sheet of magnetizable material is sandwiched between the magnetizing roller and the belt about a portion of a circumference of the magnetizing roller.

28. The coating machine of claim 27, further comprising a belt temperature control device arranged to heat or cool the belt such that a temperature of the belt is different from a temperature of the sheet of magnetizable material.

29. The coating machine of claim 27, further comprising an air handling device arranged to direct the flow of air at a predetermined temperature across said sheet of magnetizable material.

* * * * *